US005513618A

United States Patent [19]

Rich et al.

[11] Patent Number: 5,513,618

[45] Date of Patent: * May 7, 1996

[54] HIGH PERFORMANCE IGNITION APPARATUS AND METHOD

[75] Inventors: Stanley R. Rich, deceased, late of Grantham, N.H.; Shirley C. Rich, executrix, Wellesley Hills, Mass.

[73] Assignee: Enox Technologies, Inc., Natick, Mass.

[ * ] Notice: The portion of the term of this patent subsequent to Jul. 4, 2012, has been disclaimed.

[21] Appl. No.: 204,319

[22] PCT Filed: Sep. 17, 1992

[86] PCT No.: PCT/US92/07885

§ 371 Date: Jun. 23, 1994

§ 102(e) Date: Jun. 23, 1994

[51] Int. Cl.[6] ..... F02P 3/09; F02P 15/10; F23Q 3/00

[52] U.S. Cl. ..... 123/598; 123/604; 123/605; 123/606; 123/623; 123/625; 123/643; 361/256

[58] Field of Search ..... 123/596, 598, 123/604–607, 623, 625, 637, 643; 315/209 CD; 361/256

[56] References Cited

U.S. PATENT DOCUMENTS 3,302,629 2/1967 Shano ..... 123/598
4,149,508 4/1979 Kirk, Jr. et al. ..... 123/598
4,562,823 1/1986 Moritugu et al. ..... 123/596
4,608,958 9/1986 Sakakibara et al. ..... 123/605
4,733,646 3/1988 Iwasaki ..... 123/598

*Primary Examiner*—Andrew M. Dolinar
*Attorney, Agent, or Firm*—Alan R. Loudermilk

[57] ABSTRACT

Apparatus and method for a plasma discharge for ignition in an internal combustion engine. A digital electronic system controls ignition performance and can provide an ignition discharge throughout an entire power stroke of a piston in a cylinder. The discharge can be controlled by a signal from a conventional distributor, crank trigger or other source. Controllable discharge of a capacitor occurs through the primary winding of an ignition coil. In addition, the capacitor may be both discharged and recharged in an oscillatory manner through the primary of the ignition coil. Such oscillatory discharging and recharging of the capacitor results in energy being delivered to the spark plug during both discharge and recharge cycles, thereby resulting in the delivery of discharge energy to the spark plug on a substantially continuous basis.

39 Claims, 7 Drawing Sheets

PICK-UP DEVICE
12
26
27
13
ENGINE
10
DISTRIBUTION CIRCUIT
20
24-1
24-8
24-3
CYLINDER 3
ON
OFF
CLOCK
CLOCK AND TIMING CIRCUIT
FLIP-FLOP
40
41
22
44
SW1
SW2
43
L1
C2
V1
C1
VOLTAGE REGULATOR
60
LOAD
SPEED
DC SOURCE
62
46
50
CYLINDER 1
CYLINDER 2
SW1
SW2
81
82
83
70
72

HIGH PERFORMANCE IGNITION APPARATUS AND METHOD

BACKGROUND OF THE INVENTION

1. Field of the Invention

This invention relates to ignition systems for internal combustion engines, and more particularly to a method and apparatus for providing controllable, continuous energy discharges to an ignition device by oscillatory discharging and/or recharging of a capacitor through an ignition coil primary.

2. Description of the Prior Art

Conventional ignition systems have a battery, an ignition coil, a condenser (capacitor), breaker points and a distributor. These systems are known to have a number of disadvantages related to durability and performance. For example, in a typical ignition system, the voltage available to make a spark is at a maximum at idling speeds and decreases as engine speed (or ignition frequency) increases. It would be preferred to have a higher voltage available for the spark at higher firing frequencies.

With advances in solid state electronics, transistorized electronic ignition systems have become available, and automobile manufacturers now typically provide either inductive or capacitive discharge ignition systems with their products. An inductive discharge ignition system uses a transistor to cut off the current flowing in the primary winding of the ignition coil. A capacitive discharge ignition system typically uses a silicon controlled rectifier to discharge a previously charged capacitor through the primary winding of the ignition coil. As in the conventional ignition system, the voltage applied to the spark plug in an electronic ignition system typically decreases as engine speed increases.

Because the duration of the spark in the above-described ignition systems is typically relatively short (between 50 and 150 microseconds), the amount of energy that the spark plug delivers within the cylinder is limited. Moreover, if the air-to-fuel ratio is not ideal for combustion during this extremely short period of spark duration, combustion will either not occur or will be only partially complete. Spark plugs therefore become fouled, misfire and require frequent cleaning or replacement.

Recently, there has been some development toward the use of a high energy plasma to ignite fuel mixtures, and toward the use of multiple sparks and extended ignition systems. The plasma ignition systems, however, appear to have higher cost, more limited durability and higher energy requirements compared to other types of ignition systems, and they typically require a specially produced, extremely short-lived plasma plug. These systems also do not appear to provide ignition energy of long enough duration in each cylinder to ensure that substantially all combustible components of the fuel are ignited and fully burned.

SUMMARY OF THE INVENTION

A method and apparatus are disclosed in which a continuous plasma discharge may be created throughout any desired portion of, or up to or beyond, the entire power stroke of each cylinder of an internal combustion engine, including through the use of conventional spark plugs. A digital electronic system controls ignition performance without requiring extensive engine modification or special spark plugs.

In particular, the present invention provides for controllable discharge of a capacitor through the primary winding of an ignition coil. In certain preferred embodiments, the capacitor is discharged and recharged in an oscillatory manner through the primary of the ignition coil. Such oscillatory discharging and recharging of the capacitor results in energy being delivered to the spark plug during both discharge and recharge cycles, thereby resulting in the delivery of discharge energy to the spark plug on a substantially continuous basis.

The system disclosed herein is applicable to any internal combustion engine that requires ignition for its operation. It draws less power than conventional high energy ignition systems and can provide an ignition discharge throughout an entire power stroke, thus permitting more complete fuel combustion, reduced polluting emissions and increased engine efficiency. The discharge is controlled by a signal from a conventional distributor, crank trigger or other source that produces an accurate timing signal.

The invention described herein is particularly well-suited to conventional internal combustion engines since it is low cost and easily retrofitable using standard spark plugs as continuous fuel ignitors. The disclosed invention also will improve the performance of diesel or other engines that ordinarily do not use ignition systems.

BRIEF DESCRIPTION OF THE DRAWINGS

The present invention will be better understood hereinafter as a result of a detailed description of the preferred embodiments when taken in conjunction with the following drawings in which.

DETAILED DESCRIPTION OF THE PREFERRED EMBODIMENTS

Figure 1A:
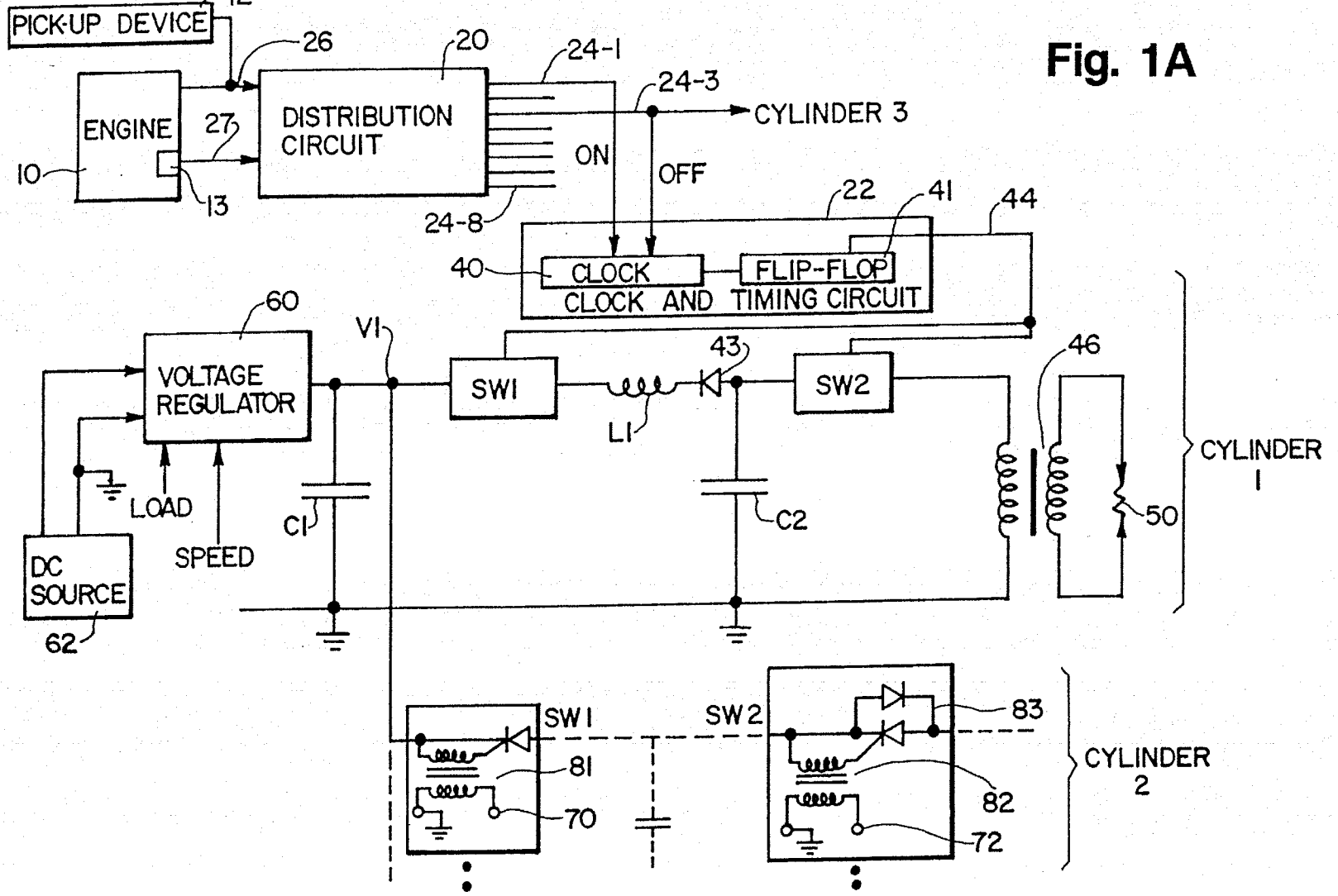
FIG. 1A is a block diagram illustrating one embodiment of the present invention.

With reference to FIG. 1A, a first embodiment of the present invention will be described. Pickup device 12, which can be connected to engine 10 by means of a conventional distributor, crank trigger or other source, and which can be triggered by the ignition "points" or by magnetic or optical means, produces a series of timing pulses 26 indicative of piston position. Separate sensor 13 provides signal 27 indicative of the position of the piston in cylinder 1. With these two signals, the precise location of any cylinder piston can be determined.

Distribution circuit 20 receives the serial stream of timing pulses 26 and signal 27. Circuit 20 thereafter generates signals on parallel output lines 24-1 to 24-8 to control spark plug firing in the respective cylinders. In FIG. 1A, distribution circuit 20 is shown having eight parallel output lines 24-1 to 24-8 for controlling plasma discharge in cylinders 1 to 8. Of course, the present invention is applicable to engines having any number of cylinders.

Each one of output lines 24-1 to 24-8 is coupled to clock and timing circuit 22. In the preferred embodiment, each cylinder has its own clock and timing circuit 22. Timing circuit 22 for cylinder 1 receives its ON signal when it is required from output line 24-1, timing circuit 22 for cylinder 2 receives its ON signal from output line 24-2 at the proper time, and so on. In the embodiment described with reference to FIG. 1A, the OFF signal is the ON signal of a selected succeeding or other cylinder. For example, if it is desired to have a continuous ignition discharge for the entire power stroke of 180 crank angle degrees in an 8 cylinder engine, the OFF signal for cylinder 1 is the ON signal for cylinder 3, the OFF signal for cylinder 2 is the ON signal for cylinder 4, and so on. Other combinations are also possible; for example, ignition will exist for half of the power stroke (90 degrees) if the cylinder 2 ON signal ends the ignition in cylinder 1, and ignition will last for the entire power stroke plus half of the exhaust stroke (270 degrees) if the cylinder 4 ON signal is the OFF signal for cylinder 1. These relationships are valid and exact regardless of engine speed. Waveform A in FIG. 2 represents the ON/OFF period for the clock and timing circuit 22 of a typical cylinder operating in accordance with the present invention.

Figure 2A:
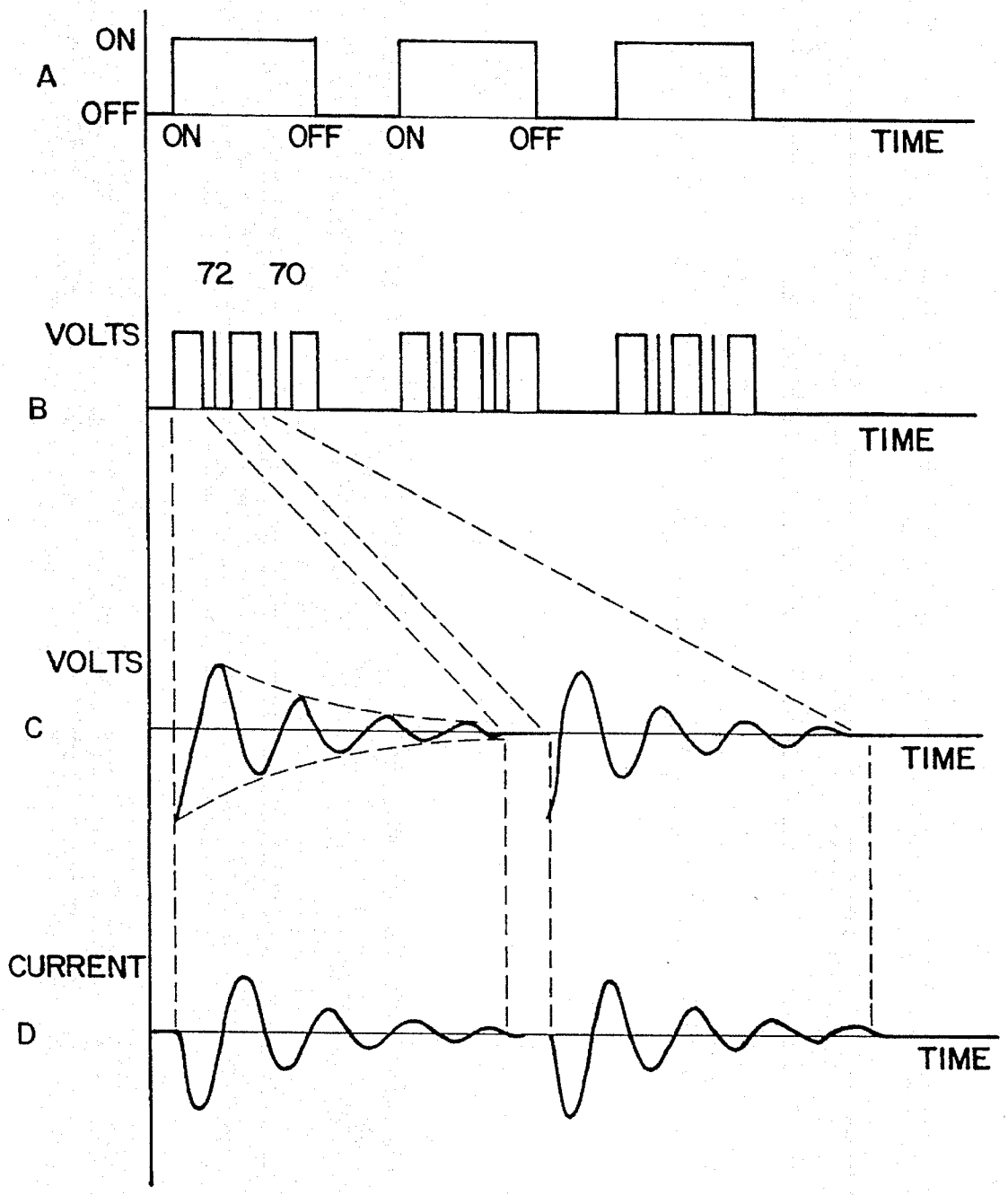
FIGS. 2A and 2B illustrate timing diagrams depicting typical signal waveforms for various embodiments of the present invention.

Within each clock and timing circuit 22, clock 40 is coupled to flip-flop 41. When the clock is on, circuit 22 produces pulses and platforms which control the ignition in the specified cylinder. In FIG. 2A, pulse 70 and platform 72 of waveform B indicate voltages which appear on timing output line 44. Pulse 70 indicates the voltage at point 70 of FIG. 1A (at switch SW1 of cylinder 2), and typically lasts about 15 microseconds. Platform 72 indicates the voltage at point 72 of FIG. 1A (at switch SW2 of cylinder 2), and can last from 200 to 600 microseconds. When timing circuit 22 receives an ON signal on line 24-1, the series of pulses 70 and platforms 72 shown in waveform B begin.

When platform 72 is at a high voltage, switch SW2 closes and capacitor C2 discharges through ignition coil 46, providing an oscillatory discharge at spark plug 50. Waveform C of FIG. 2A represents the voltage across the primary of ignition coil 46, and waveform D represents the current in the secondary winding of ignition coil 46. Note that current waveform D is 90 degrees out of phase from voltage waveform C.

Platform 72 is periodically interrupted by pulses 70 to permit capacitor C2 to be recharged. Once an OFF signal is received, switch SW2 remains open until the next ON signal is received, thus allowing capacitor C2 to remain charged. After an ON signal is received, and until an OFF signal is received, clock and timing circuitry 22 will provide control signals which will allow capacitor C2 to discharge through the primary of ignition coil 46.

Switch SW1 couples voltage V1 to inductor L1, which in turn is coupled to capacitor C2 and the input of second switch SW2 through diode 43. Voltage V1 is controlled by voltage regulator 60 connected to direct current voltage source 62, which preferably provides between 200 and 300 volts. (Direct current voltage sources are well known in the art, and may, for example, comprise an alternator with a rectifier). Inductor L1 and capacitor C2 are arranged so that when switch SW1 is closed, the voltage across capacitor C2 will rise to about twice voltage V1, typically between 400 and 600 volts.

Voltage regulator 60 can adjust the voltage V1 based on any desired function or variable, including engine speed, load or fuel input. For example, voltage regulator 60 can be controlled by a current or voltage proportional to speed as measured by engine rotation in revolutions per minute (RPM), or by a current or voltage proportional to fuel input as measured by throttle position or a signal to a fuel injector.

In the embodiment illustrated in FIG. 1A, each cylinder has its own switches SW1 and SW2, inductor L1, capacitor C2, ignition coil 46 and spark plug 50, as well as its own timing circuit 22. In addition, diode 43 may be interposed between inductor L1 and capacitor C2 to ensure that capacitor C2 will be charged to the maximum peak voltage. The spark plugs and ignition coil can be of the standard types readily available in the industry, or other types depending upon the particular application. In other embodiments, more than one spark plug 50 may be connected to a single ignition coil, depending on the type of engine and particular desired operating characteristics.

The logic circuitry that generates the digital signals controlling the discharge in spark plug 50 are common in TTL or CMOS logic families, and the specific components can readily be chosen by one skilled in the art. For example, switches SW1 and SW2 can be silicon controlled rectifiers or MOSFET or bipolar transistors. With reference to the switches depicted in more detail with respect to cylinder 2 of FIG. 1A, one possible embodiment is shown where the switches comprise silicon controlled rectifiers (SCR) 81 and 82, and with diode 83 connected across SCR 82 to permit current to flow in both directions. As indicated in FIG. 1A, controlling signals for SCRs 81 and 82 may be applied through one primary lead of a transformer, with the other primary lead of the transformer grounded.

Capacitor C1 should have sufficient capacitance to assure that the voltage across it remains relatively constant regardless of the demands put on it by the engine during operation. In practice, a capacitor of approximately 470 microfarads has been found to be appropriate for this use, but generally it may be between about 200 and 2000 microfarads as determined by the requirements of the particular engine and application.

Capacitor C2 is chosen such that its capacitance value and that of the net inductance of loaded ignition coil 46 allow the circuit to resonate at a frequency of about 2 to 15 kHz. A capacitance of approximately 1.5 microfarads has been found suitable for capacitor C2, although it may range from about 0.5 to 10 microfarads, with the optimum value for the capacitance of capacitor C2 depending on the particular requirements of the particular circuit and application.

Waveforms C and D of FIG. 2A represent the voltage and current oscillations that occur when capacitor C2 is connected by switch SW2 to spark plug 50 through the primary winding of ignition coil 46. The waveforms are exponentially decreasing sinusoidal waves which repeat in a train of waveforms. There will be fewer members of this train of waveforms, that is, fewer capacitor discharges, as the time in each power stroke decreases. Indeed, at the highest engine speeds (above 5000 to 8000 RPM, depending on the particular engine application), there may time for only a single discharge.

Figure 1B:
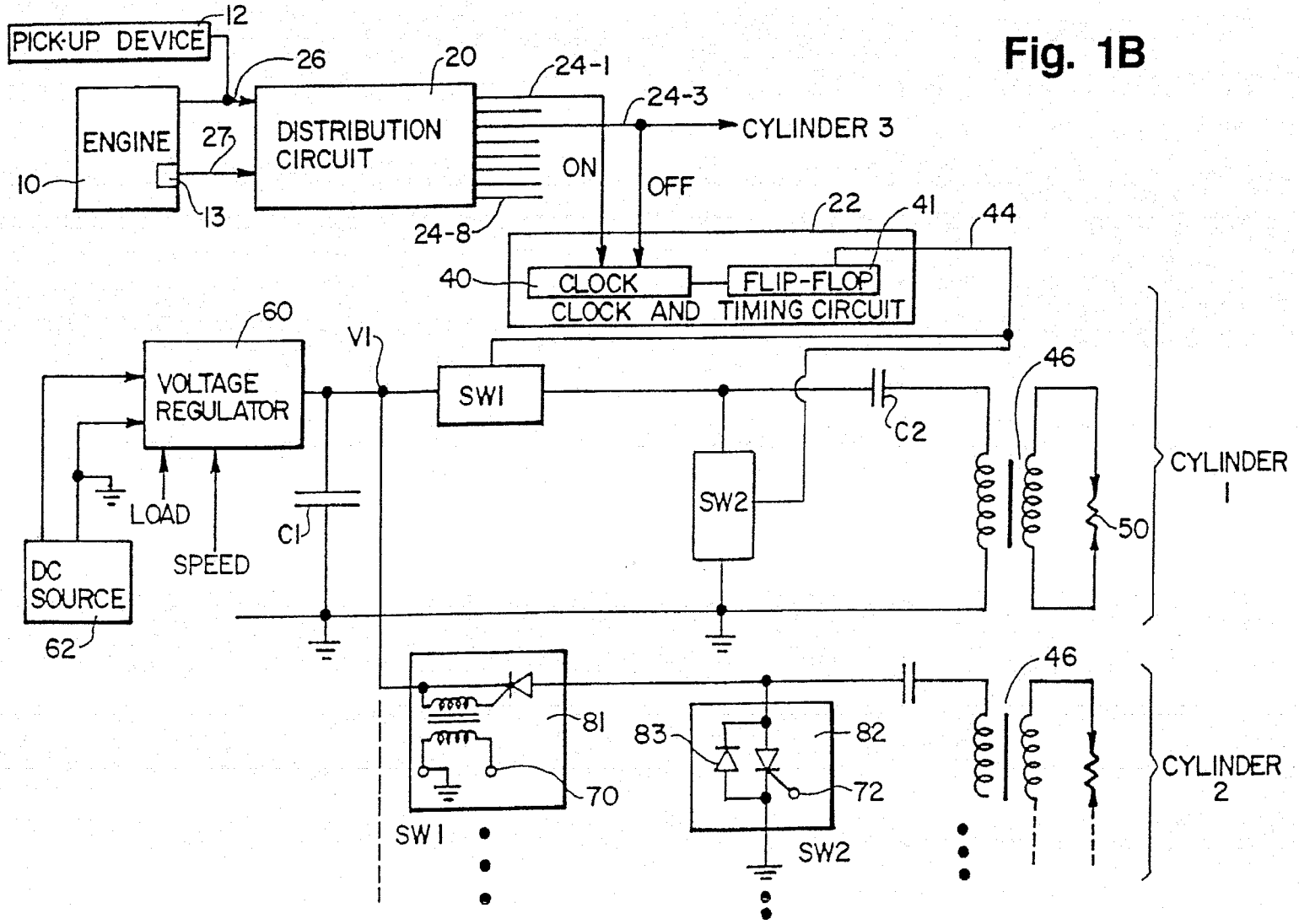
FIG. 1B is a block diagram illustrating the embodiment of FIG. 1 configured to provide oscillatory discharge and recharge of the capacitor.

Referring now to FIG. 1B, an embodiment of the present invention will now be described in which oscillatory discharge and recharge of capacitor C2 through the primary of ignition coil 46 is utilized to deliver discharge energy to spark plug 50 on a substantially continuous basis.

The embodiment of FIG. 1B differs from the embodiment of FIG. 1A essentially in the following respects: the positions of capacitor C2 and switch SW2 have been exchanged (with switch SW2 also simplified in that the SCR may be controlled without a transformer); and inductor L1 and diode 43 have been eliminated. While the basic operation and timing of the embodiment of FIG. 1B is similar to the embodiment of FIG. 1A, additional benefits and advantages are achievable with the oscillatory discharge and recharge of capacitor C2 with the embodiment of FIG. 1B as discussed hereinafter.

Figure 2B:
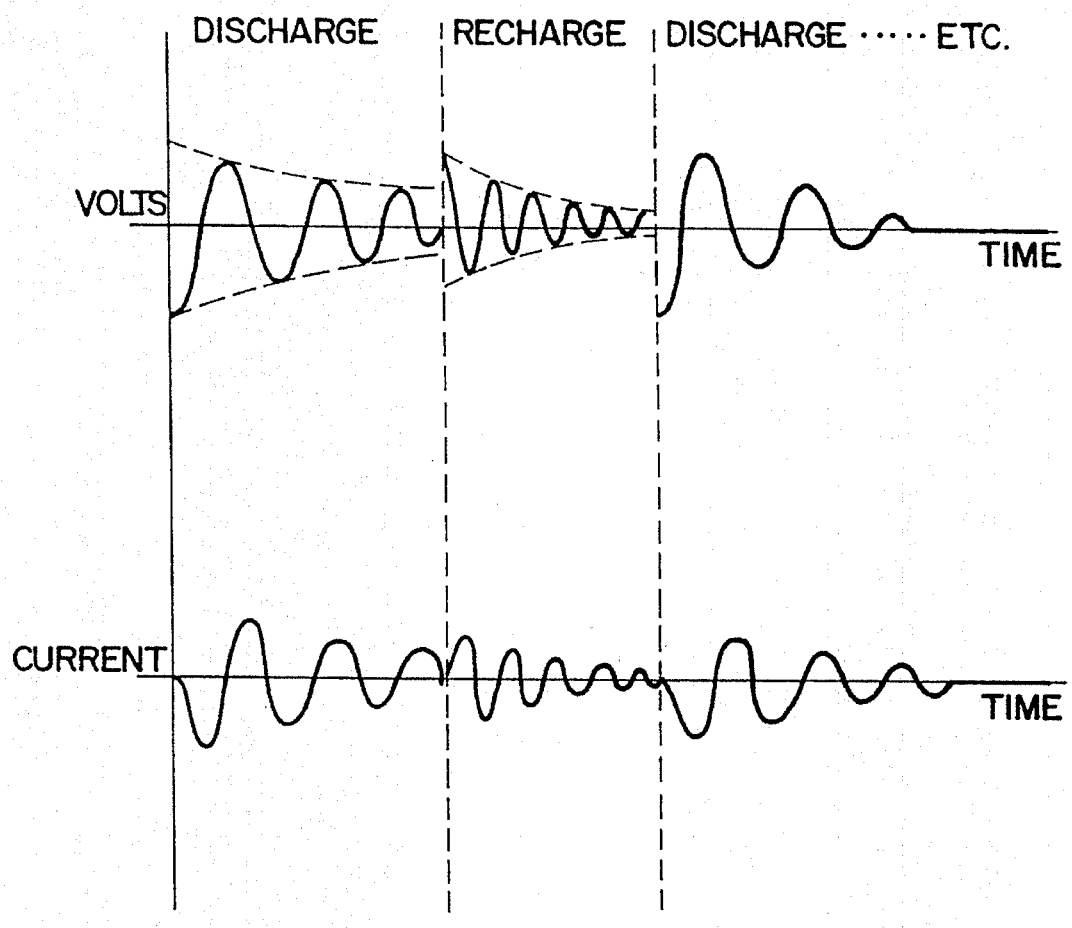

During discharge of capacitor C2, switch SW1 is open and switch SW2 is closed. As illustrated by the voltage and current waveforms of FIG. 2B, representing, respectively, the voltage across the primary winding of ignition coil 46 and the current induced in the secondary winding of ignition coil 46 during discharge and recharge of capacitor C2 (generally without reflecting DC displacements), capacitor C2 discharges in an oscillatory manner through the primary of ignition coil 46. The frequency of the oscillatory discharge of C2 is principally determined by the capacitance of capacitor C2 and the reflected load presented by the primary of ignition coil 46. During recharge of capacitor C2, switch SW1 is closed and switch SW2 is opened. With the serial connection of capacitor C2 and the primary winding of ignition coil 46 as illustrated in FIG. 1B, capacitor C2 recharges also in an oscillatory manner through the primary of ignition coil 46, again with the frequency of the oscillatory discharge principally determined by the capacitance of capacitor C2 and the reflected load presented by the primary of ignition coil 46.

Referring again to the waveforms of FIG. 2B, it can be seen that, with the embodiment of FIG. 1B, oscillatory spark plug discharges can be achieved during both the discharging and recharging of capacitor C2. The use of the discharging as well as the recharging current for capacitor C2 significantly extends and lengthens the duration of the spark plug discharge, increases the ignition capability of the present invention, and increases its energy efficiency.

It is to be noted that, for the embodiment illustrated in FIG. 1B, the timing and control signals applied to switches SW1 and SW2 typically are adjusted from what is shown in FIG. 2A so that, in preferred embodiments, the discharge and recharges durations are approximately the same, although the precise timing relationships for optimum operation may vary depending upon the particular application.

Figure 3:
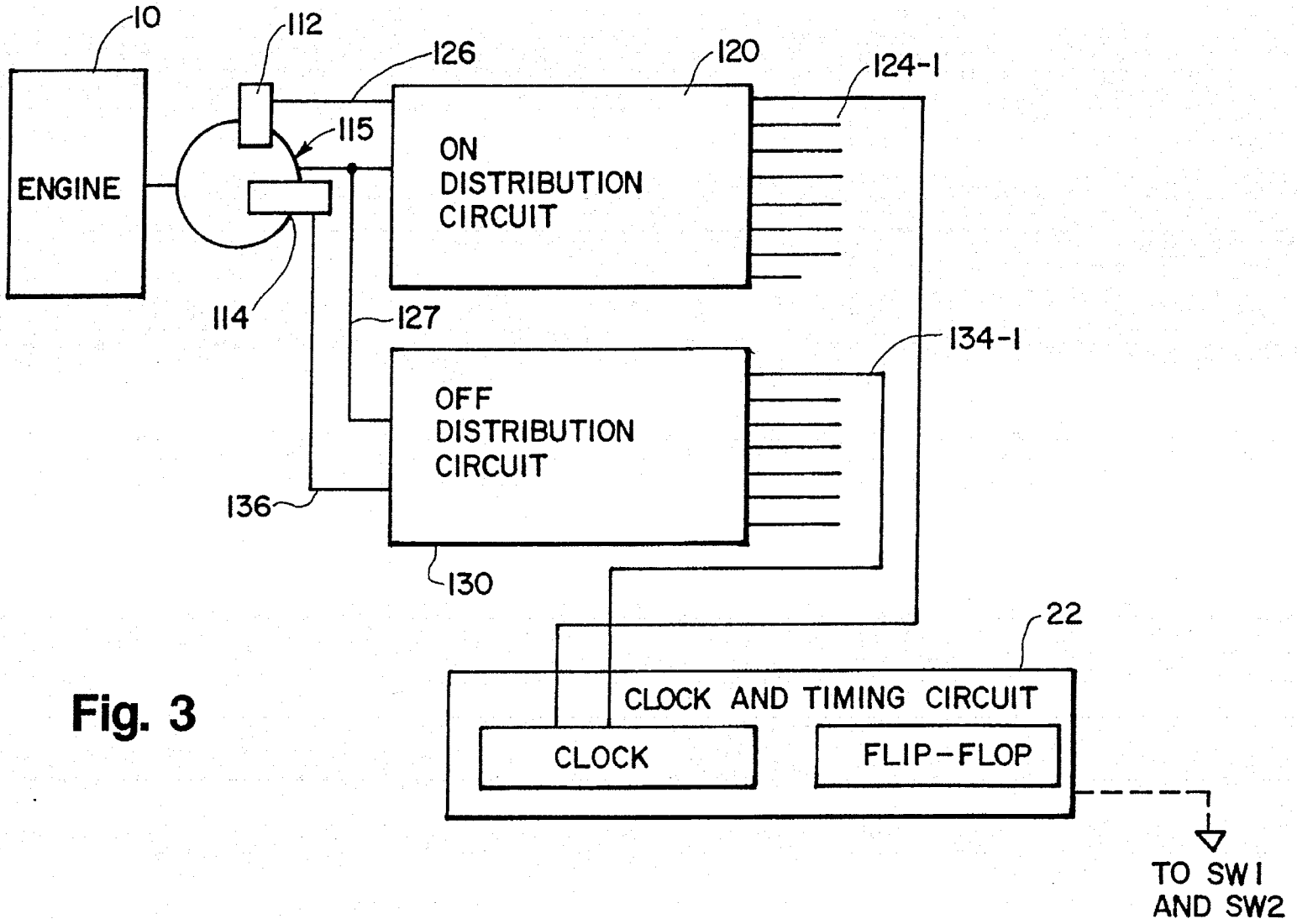
FIG. 3 is a block diagram illustrating a second embodiment of the present invention.

Referring now to FIG. 3, an embodiment for selecting the duration of the ignition discharge in each cylinder as measured by crank angle degrees will now be described. This embodiment produces ON and OFF signals that are independent of engine rotation speed. As described in more detail with reference to FIG. 1A, pickup device 112 generates a continuous series of timing pulses along line 126, which, along with cylinder 1 identifying pulse 127 generated by conventional pickup or other identifying element 115, are the inputs to ON signal distribution circuit 120, which, in turn, generates a series of individual ON pulses 124 that are sent to the ignition circuits of individual cylinders in the proper predetermined sequence.

With the embodiment of FIG. 3, second pickup device 114, which typically is of the same type as pickup device 112, is physically positioned some desired number of crank angle degrees (preferably from 15 to 330 degrees depending on the engine) behind first pickup device 112. Pickup device 114 generates a second series of OFF timing pulses 136, which pulses occur the selected number of crank angle degrees after the corresponding ON timing pulses 126. The cylinder ignition and switching electronics for the embodiment of FIG. 3 may be similar to those of the embodiments of FIGS. 1A or 1B.

The continuous series of OFF timing pulses 136, along with cylinder 1 identifying pulse 127, are the inputs to OFF pulse distribution circuit 130. This circuit, similar to ON distribution circuit 120, generates a series of OFF pulses 134 that are distributed to the corresponding cylinder ignition circuits turned on by ON pulses 124. Thus, for example, if continuous ignition discharge is initiated in cylinder 1 by ON pulse 124-1, it can be turned OFF by cylinder 1 OFF pulse 134-1. The timing system illustrated in FIG. 3 allows the ignition discharge interval to be selected to have any desired duration in crank angle degrees.

Figure 4:
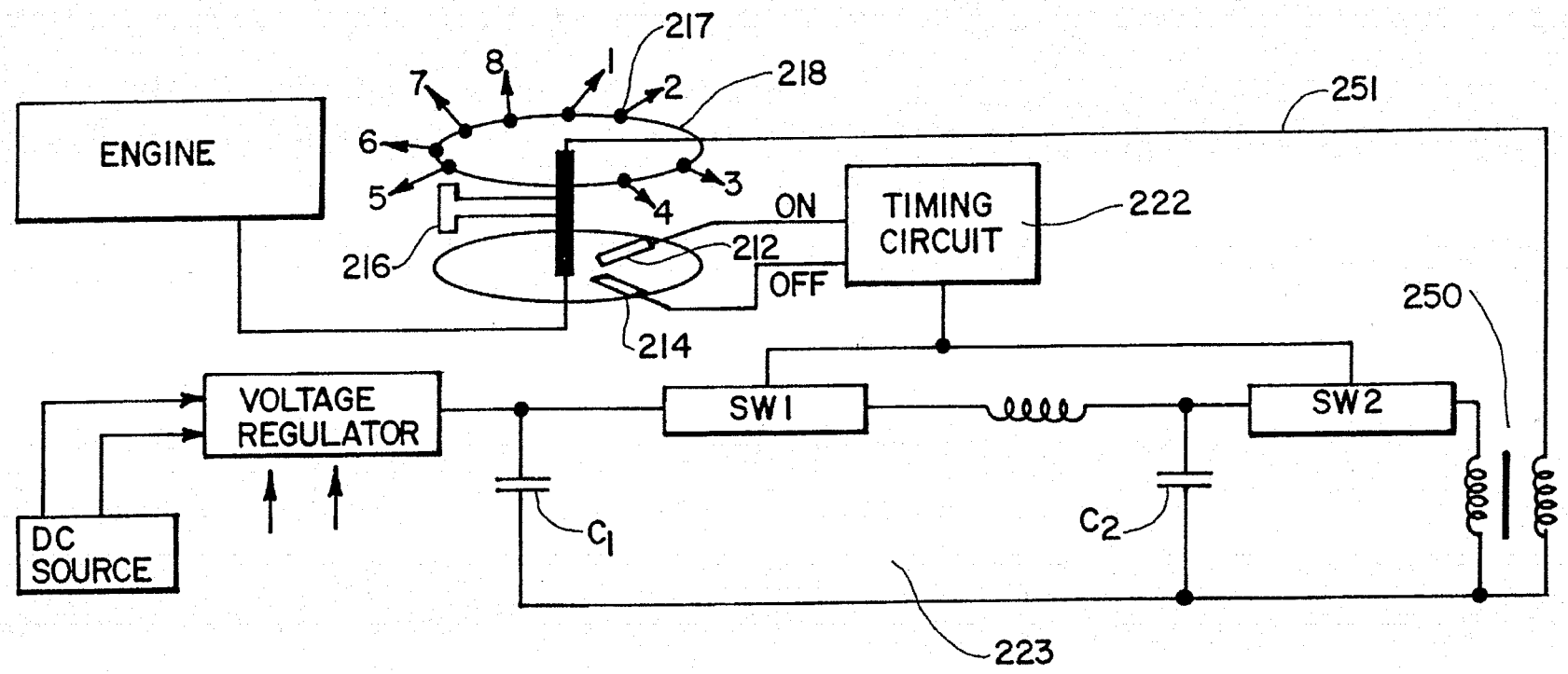
FIG. 4 is a block diagram illustrating a third embodiment of the present invention.

With reference to FIG. 4, an embodiment of the present invention is illustrated that uses conventional distributor 218 to generate the timing pulses for timing circuit 222, which is similar to timing circuits 22 described with reference to FIG. 1A. Distributor 218, however, distributes the ignition energy to the individual cylinders in proper sequence as opposed to separate distribution circuits as discussed, for example, with references to FIGS. 1A, 1B and 3.

In this embodiment, distributor 218 has either mechanical "points" or magnetic or optical ON and OFF sensors 212 and 214 that generate ON and OFF timing pulses that control single timing circuit 222, which controls single ignition energy generating circuit 223. Circuit 223 is similar to the ignition circuits described in the embodiment shown in FIG. 1A. However, with the embodiment of FIG. 4, only one ignition circuit is needed, rather than an ignition circuit per cylinder as with the embodiment of FIG. 1A. The output from single ignition coil 250 is distributed to the appropriate cylinder at the proper time by the rotor and distributor cap of distributor 218. Rotor "blade" 216 is broadened sufficiently to distribute the ignition energy over a wide angle to the individual spark plugs by stator electrodes 217. With this embodiment, ignition energy may be provided in each cylinder over, for example, about 45 to 70 crankshaft angle degrees. This embodiment has been demonstrated on a dynamometer to produce 40 more horsepower, a 12% increase, while consuming 8% less fuel than a conventional high energy ignition system previously used on the same engine.

Tests have shown, unexpectedly, that, with an ignition system in accordance with the present invention operating under practical engine conditions, ignition advance of up to 100° before the piston was at top center did not cause undesirable detonation including knocking or pre-ignition in the engine, whereas, in a conventional spark system against which this system was compared, knocking occurred at 37° before the piston was at top center. In addition, with this system engine efficiency was measured as essentially constant over the range 32° to 47° before the piston was at top center, whereas, by comparison, the conventional spark system showed a sharp peak of efficiency to which engine timing had to be exactly tuned to reach maximum efficiency. Under conditions of exhaust gas recirculation ("EGR") of up to 20%, an ignition system in accordance with the present invention had essentially constant output and fuel consumption over the ignition timing range of 40° to 100° before top dead center. Under the same EGR conditions, the conventional spark ignition system could operate only in a narrow range of a few degrees in ignition timing to which the engine had to be precisely tuned to achieve maximum efficiency. Adoption of the ignition system according to the present invention should make it possible to substantially eliminate both timing controls and the need for high-test or high octane gasoline in engines.

Figure 5:
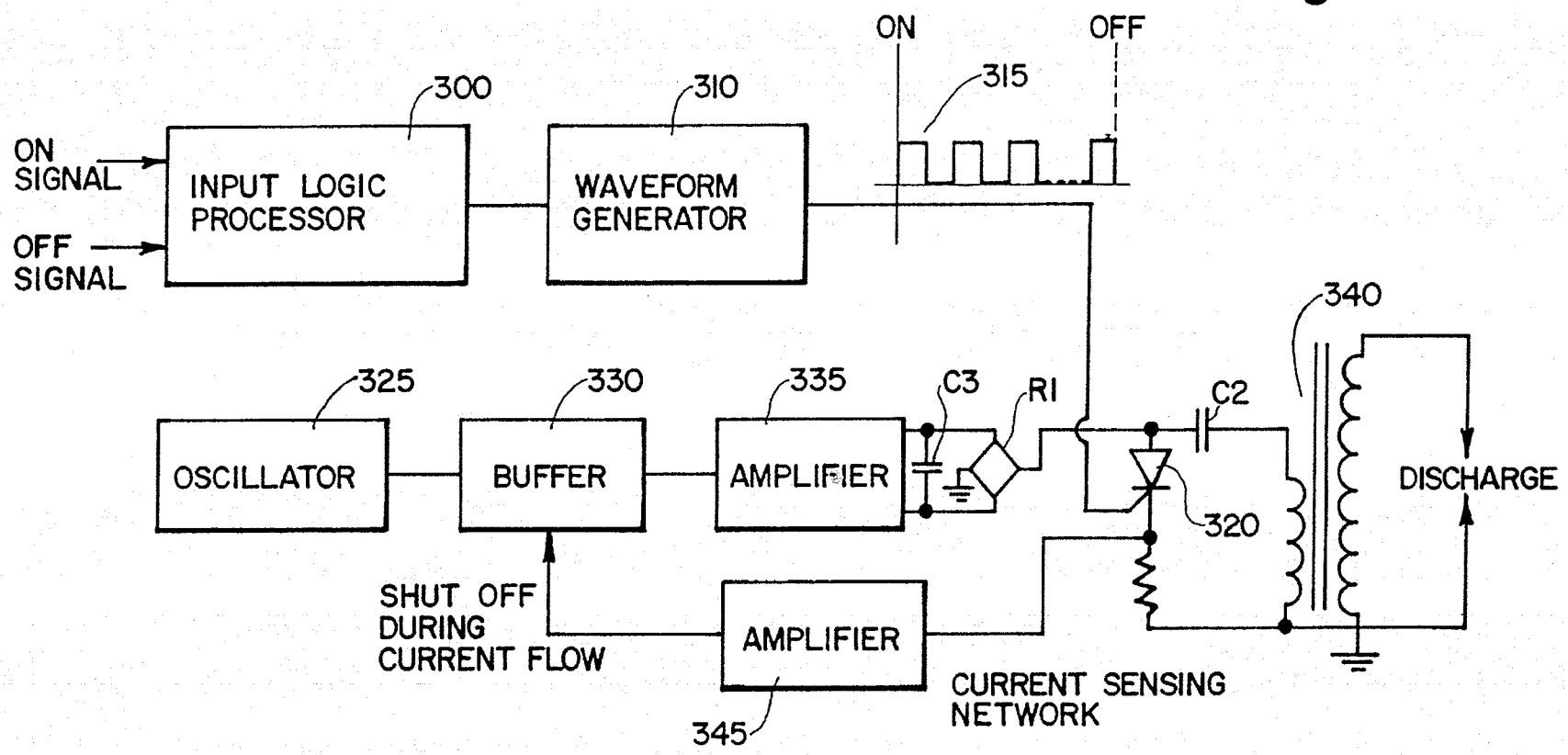
FIG. 5 is a block diagram illustrating a fourth embodiment of the present invention.

An alternative embodiment of the electronic ignition system is illustrated in FIG. 5. ON and OFF signals generated by any of the embodiments described above, are amplified and sharpened in input logic processor 300, which turns on waveform generator 310 to produce waveform 315. Waveform 315 is applied to the gate of SCR 320, which acts as a switch to discharge capacitor C2. Capacitor C2 is charged to a high DC voltage by the rectified output of oscillator 325, buffer 330, and amplifier 335, which are normally on. When SCR 320 conducts, a voltage is sensed due to the current that flows in the circuit comprising SCR 320, capacitor C2, and the primary of ignition coil 340. This voltage is amplified by amplifier 345 and acts to turn off buffer 330.

When the voltage in waveform 315 is LOW, SCR 320 does not conduct and oscillator 325, buffer 330, and amplifier 335 again function at full power to recharge capacitor C2 so that it can be discharged again when the gate of SCR 320 is turned on by the succeeding HIGH voltage platform of waveform 315. Oscillator 325 runs continuously at a frequency between 18 and 100 kilohertz, and in preferred embodiments is about 90 kilohertz.

The embodiment illustrated in FIG. 5 has the advantage of instant cut off and instant restart of chain comprising oscillator 325, buffer 330, amplifier 335, resulting in a fast recharge of capacitor C2. Because oscillator 325 runs continuously, there is no delay in start up, as there is when using self-excited inverters that are common in previous capacitive discharge ignition systems. Another advantage of this embodiment is that the turn-off and turn-on is accomplished at low power levels in the buffer stage, allowing all controls to be at low power using TTL and CMOS logic elements.

Waveforms C and D of FIG. 2A are exponentially decaying sinusoids. There are no pulses or sparks. The secondary circuit current waveform D compared to the primary circuit voltage waveform C shows the essentially identical form of both applied voltage and "spark"-plug current. The continuous current waveform demonstrates that the discharge has generated a long lasting plasma that is ideal for stabilizing combustion and achieving optimum combustion.

Waveforms that may be generated by this preferred embodiment of the present invention will now be discussed in greater detail with reference to the waveforms of FIG. 2B. The waveforms of FIG. 2B expand waveforms C and D of FIG. 2A and illustrate that, in the time interval between the oscillatory discharges of capacitor C2 in FIG. 5, produced by platforms 315, the current that recharges capacitor C2 also passes through the primary of ignition coil 340. This rectified but unfiltered DC current, due to high frequency AC components generated by amplifier 335 of FIG. 5, also has an oscillatory component that can be made to produce an additional spark plug discharge during oscillatory recharge of capacitor C2. It should be noted that the frequency components of the oscillator recharge depend primarily from the output of amplifier 335, and thus, in general, are of a frequency unrelated to and different from the resonance frequency during discharge. It should be further noted that the waveforms of FIGS. 2A and 2B are generalizations of the more complex waveforms actually produced, which may include, for example, other frequency components and/or harmonics, particularly with embodiments such as discussed above with respect to FIG. 5. In any event, as with the embodiment discussed with reference to FIG. 1B, and as illustrated by the waveforms of FIG. 2B, respectively, oscillatory discharges and recharges of capacitor C2 induce oscillatory voltages across the primary of ignition coil 340 (such as shown in the voltage waveform of FIG. 2B), and correspondingly induce oscillatory current in the secondary of ignition coil 340 (such as shown in the current waveform of FIG. 2B).

The high frequency components from amplifier 335 may be desirably generated, for example, by filtering the output of amplifier 335 with suitable capacitor C3 connected as shown in FIG. 5. With a nearly ideal square wave output from amplifier 335, bridge rectifier R1 produces a DC signal with little AC components. With capacitor C3, however, higher harmonics are removed from the square wave output of amplifier 335, thereby resulting in a significant AC signal component being produced on the output of rectifier R1. Alternatively, with suitable components selected for oscillator 325, buffer 330 and amplifier 335, and suitable control circuitry, the duty cycle of the signal output from amplifier may be controlled to be other than the 50% duty cycle for the ideal square wave, which also will result in a significant AC signal components being produced on the output of rectifier R1. Other methods for generating suitable AC components will be apparent to those skilled in the art.

Thus, the embodiment of the present invention illustrated in FIG. 5 also can be made to produce spark plug discharges as illustrated by the waveforms of FIG. 2B, both during discharging as well as recharging of capacitor C2. As with the embodiment of FIG. 1B, the use of the discharging as well as the recharging current significantly extends and lengthens the duration of the spark plug discharge, increases the ignition capability of the present invention, and increases its energy efficiency.

Although several embodiments of the invention have been illustrated and described, it is anticipated that various changes and modifications will be apparent to those skilled in the art, and that such changes may be made without departing from the scope of the invention as defined by the following claims:

What is claimed is:

1. An ignition system comprising:

sensor means for providing a signal representative of the position of a piston in a cylinder of an engine;

means for providing one or more control signals in response to said signal from said sensor means;

first switching means coupled to a first capacitor and a second capacitor and controlled by at least one of said control signals, wherein a first position of said first switching means permits said first capacitor to charge said second capacitor to a voltage, and a second position of said first switching means permits said first capacitor to charge to a predetermined voltage;

second switching means coupled to said second capacitor and to an ignition coil and controlled by at least one of said control signals, wherein a first position of said second switching means permits said second capacitor to discharge in a damped oscillatory manner through said ignition coil, and a second position of said second switching means permits said second capacitor to be charged in an oscillatory manner by said first capacitor;

wherein said ignition coil is coupled to a spark plug in an engine cylinder.

2. The ignition system of claim 1, wherein said voltage across said first capacitor is controlled by one or more variables relating to engine performance.

3. The ignition system of claim 2, wherein said means for providing one or more control signals closes said first switching means and opens said second switching means to permit the charging of said second capacitor, and then opens said first switching means and closes said second switching means to permit the discharging of said second capacitor.

4. The ignition system of claim 3, wherein said sensor means determines crank angle position in said engine.

5. The ignition system of claim 3, wherein said sensor means determines the position of a distributor rotor in said engine.

6. The ignition system of claim 2, wherein said first and second switching means are semiconductive switching devices having a transconductive path and a control electrode.

7. A method for igniting a fuel mixture in a cylinder comprising:

obtaining a timing signal which is a function of a piston position;

using said timing signal to generate one or more control signals to control a first switch to allow the charging of a discharge capacitor to a voltage in an oscillatory manner, and to control a second switch to allow the discharging of said discharge capacitor through an ignition coil in a damped oscillatory manner;

wherein said ignition coil is coupled to a spark plug in a cylinder.

8. A method for igniting a fuel mixture in a cylinder comprising:

obtaining a timing signal which is a function of a piston position;

using said timing signal to generate one or more control signals to control a first switch to allow the charging of a discharge capacitor to a voltage, and to control a second switch to allow the discharging of said discharge capacitor through an ignition coil;

wherein said ignition coil is coupled to a spark plug in a cylinder, and wherein said discharge capacitor is coupled to a storage capacitor by means of said first switch, and wherein the voltage on said storage capacitor is increased proportionally with increases in engine rotation or fuel input.

9. The method of claim 8, wherein said discharge capacitor is charged to about twice the voltage of said storage capacitor by means of inductive charging.

10. The method of claim 8, wherein the capacitance of said storage capacitor is sufficient to maintain a substantially constant voltage during operation of said ignition system, and wherein the capacitance of said discharge capacitor and the inductance of said ignition coil is sufficient to provide a resonance at a predetermined frequency to produce an exponentially decreasing sinusoidal waveform across the ignition coil.

11. The method of claim 10, wherein said discharge capacitor discharges at said predetermined resonance frequency to cause a current through said spark plug having an exponentially decreasing sinusoidal waveform at said frequency.

12. A system for igniting a fuel mixture in a cylinder, comprising: a discharge capacitor coupled to an ignition coil by means of a first switch, a recharge voltage source coupled to the discharge capacitor by means of a second switch, the recharge voltage source providing an oscillatory recharge voltage to the discharge capacitor, and control means for controlling said first and second switches, wherein the circuit comprising said discharge capacitor and said ignition coil has a resonant frequency which generates a voltage across said ignition coil comprising a plurality of an exponentially decaying sinusoidal waveforms when said first switch is closed, and an oscillatory signal is applied to said ignition coil during the time that the recharge voltage source is providing an oscillatory recharge voltage to the discharge capacitor.

13. An ignition system comprising:

a spark plug coupled to a first winding of an ignition coil;

a switching means coupling a voltage source to a discharge capacitor, and also causing discharge of the discharge capacitor through a second winding of said ignition coil;

control means for opening and closing said switching means to couple said voltage source to said discharge capacitor and said discharge capacitor to said ignition coil in synchronization with timing signals received from an engine sensor;

wherein said voltage source generates an oscillatory recharge voltage across said ignition coil during periods when the voltage source is coupled to the discharge capacitor, and wherein a signal comprising a plurality of exponentially decaying sinusoidal waveforms is generated across said ignition coil during periods when the discharge capacitor is being discharged.

14. A method for igniting a fuel mixture in a cylinder of an engine, comprising:

generating a first signal indicative of piston position in a first cylinder, for beginning ignition in said first cylinder;

generating a second signal indicative of piston position in a selected second cylinder for beginning ignition in said second cylinder;

and using said second signal to terminate ignition in said first cylinder, wherein the duration of the ignition in the first cylinder is dependent upon the particular second cylinder that is selected.

15. A method for reducing detonation during a power stroke in an internal combustion engine comprising the steps of:

furnishing a train of waveforms to a spark plug during the power stroke, wherein each waveform in the train comprises an exponentially decaying oscillatory waveform, wherein the exponentially decaying oscillatory waveforms are produced during the discharging and recharging of a discharge capacitor.

16. The method of claim 15, wherein said train of waveforms is provided by a discharge capacitor coupled to an ignition coil, and wherein the frequency of the oscillatory waveforms is determined by the capacitance of said discharge capacitor and the inductance of said ignition coil.

17. A system for igniting an air-fuel mixture in a cylinder, comprising:

a capacitor coupled to an ignition coil and a voltage source;

a semiconductive switching device having a transconductive path and control electrode for controlling conduction through said path coupled to said capacitor and said ignition coil; and a control signal for turning said switching device on and off coupled to said control electrode;

wherein when said switching device conducts, said capacitor discharges in a damped oscillatory manner through said ignition coil, and when said switching device does not conduct, said capacitor charges by means of said voltage source in an oscillatory manner through said ignition coil.

18. A system for igniting an air-fuel mixture in a cylinder, comprising:

a capacitor coupled to an ignition coil and a voltage source;

a semiconductive switching device having a transconductive path and control electrode for controlling conduction through said path coupled to said capacitor and said ignition coil; and a control signal for turning said switching device on and off coupled to said control electrode;

wherein when said switching device conducts, said capacitor discharges through said ignition coil, and when said switching device does not conduct, said capacitor charges by means of said voltage source, wherein said voltage source comprises a buffered amplifier that amplifies a signal received from an oscillator; wherein when said switch permits the discharge of said capacitor, said buffered amplifier is off; and wherein when said switch permits the charging of said capacitor, said buffered amplifier is on.

19. A method for igniting fuel with a fuel ignitor coupled to the secondary winding of an ignition coil, the ignition coil also having a primary winding, the method comprising the steps of:

discharging a capacitor through the primary winding of the ignition coil in an oscillatory manner; and recharging the capacitor through the primary winding of the ignition coil in an oscillatory manner;

wherein, energy is discharged by the fuel ignitor during both the discharging and recharging of the capacitor.

20. The method of claim 19, further comprising the steps of:

generating a first timing signal determinative of the time to initiate ignition of the fuel; and generating a second timing signal determinative of the time to cease ignition of the fuel;

wherein in response to the first timing signal the steps of discharging and recharging the capacitor are performed on a repetitive basis, and in response to the second timing signal the steps of discharging and recharging cease to be performed.

21. The method of claim 19, wherein the discharging of the capacitor produces a damped sinusoidal voltage signal of a first characteristic frequency across the primary of the ignition coil.

22. The method of claim 19, wherein the recharging of the capacitor produces a damped sinusoidal voltage signal of a second characteristic frequency across the primary of the ignition coil.

23. The method of claim 19, wherein the discharging of the capacitor produces a damped sinusoidal voltage signal of a first characteristic frequency across the primary of the ignition coil, and wherein the recharging of the capacitor produces a damped sinusoidal voltage signal of a second characteristic frequency across the primary of the ignition coil.

24. The method of claim 23, wherein the first characteristic frequency is substantially the same as the second characteristic frequency.

25. The method of claim 19, wherein the recharging of the capacitor is performed by applying to the capacitor a signal having an oscillatory component.

26. The method of claim 19, wherein the method for igniting fuel is performed in an internal combustion engine, and wherein the steps of discharging and recharging the capacitor are initiated at an engine timing of up to 100° before top dead center while avoiding detonation under practical operating conditions of the engine.

27. The method of claim 19, wherein the method for igniting fuel is performed in an internal combustion engine, and wherein the engine efficiency is maintained essentially constant over a timing range of about 32° to 47° before top dead center.

28. The method of claim 19, wherein the method for igniting fuel is performed in an internal combustion engine, and wherein the engine operates with essentially constant output and fuel consumption over a timing range of about 40° to 100° before top dead center while the engine is operating under conditions of up to 20% exhaust gas recirculation.

29. An apparatus for igniting fuel, comprising:

an ignition coil having primary and secondary windings;

a fuel ignitor coupled to the secondary winding of the ignition coil for igniting the fuel;

a capacitor coupled to the primary winding of the ignition coil;

a charging voltage source coupled to the capacitor; and timing and switching means for controllably discharging the capacitor through the primary winding of the ignition coil, the discharging of the capacitor occurring in an oscillatory manner, and for controllably recharging the capacitor with the charging voltage source through the primary winding of the ignition coil, the recharging of the capacitor also occurring in an oscillatory manner.

30. The apparatus of claim 29, wherein the discharging of the capacitor produces a damped sinusoidal voltage signal of a first characteristic frequency across the primary of the ignition coil.

31. The apparatus of claim 29, wherein the recharging of the capacitor produces a damped sinusoidal voltage signal of a second characteristic frequency across the primary of the ignition coil.

32. The apparatus of claim 29, wherein the discharging of the capacitor produces a damped sinusoidal voltage signal of a first characteristic frequency across the primary of the ignition coil, and wherein the recharging of the capacitor produces a damped sinusoidal voltage signal of a second characteristic frequency across the primary of the ignition coil.

33. The apparatus of claim 32, wherein the first characteristic frequency is substantially the same as the second characteristic frequency.

34. The apparatus of claim 29, wherein the charging voltage source comprises:

a direct current power supply having a voltage output; and a capacitor coupled between the voltage output of the direct current power supply and a reference potential;

a voltage regulator having an input and a regulated voltage output, the input of the voltage regulator being coupled to the voltage output of the direct current power supply and the output of the voltage regulator being coupled to the capacitor.

35. The apparatus of claim 34, wherein the charging voltage source further comprises a capacitor coupled between the voltage output of the direct current power supply and a reference potential.

36. The apparatus of claim 34, wherein the fuel is ignited in an internal combustion engine, and wherein the voltage regulator is variable depending upon operating characteristics of the internal combustion engine.

37. The apparatus of claim 29, wherein the timing and switching means comprises:

control circuitry means for generating timing signals including first and second timing signals;

a first switch means for coupling the capacitor with the primary winding of the ignition coil, the first switch means also being coupled to the control circuitry means and responsive to the first timing signal, wherein discharge of the capacitor through the primary winding of the ignition coil is initiated in response to the first timing signal; and a second switch means for coupling the capacitor with the charging voltage source, the second switch means also being coupled to the control circuitry means and responsive to the second timing signal, wherein recharge of the capacitor through the primary winding of the ignition coil is initiated in response to the second timing signal.

38. The apparatus of claim 29, wherein the charging voltage source comprises:

a voltage source generating an output voltage having dc and high frequency ac components; and a rectifier coupled to the voltage source and to the capacitor and the timing and switching means.

39. The apparatus of claim 38, wherein the voltage source comprises:

an oscillator;

a buffer amplifier coupled to the oscillator;

an output amplifier coupled to the buffer amplifier, the output amplifier having an output on which is generated an output voltage having dc and high frequency ac components; and a capacitor coupled to the output of the output amplifier.

* * * * *